United States Patent [19]

Yoshitomi et al.

[11] Patent Number: 4,824,493

[45] Date of Patent: Apr. 25, 1989

[54] PROCESS FOR PRODUCING A GRAIN-ORIENTED ELECTRICAL STEEL SHEET HAVING IMPROVED MAGNETIC PROPERTIES

[75] Inventors: Yasunari Yoshitomi; Kenzo Iwayama, both of Kitakyushu, Japan

[73] Assignee: Nippon Steel Corporation, Tokyo, Japan

[21] Appl. No.: 13,887

[22] Filed: Feb. 12, 1987

[30] Foreign Application Priority Data

Feb. 14, 1986 [JP] Japan ..... 61-028933

[51] Int. Cl.[4] ..... H01F 1/04

[52] U.S. Cl. ..... 148/111; 148/112

[58] Field of Search ..... 148/111, 112

[56] References Cited

U.S. PATENT DOCUMENTS

| | | | |
|---|---|---|---|
| 3,632,456 | 1/1972 | Sakakura et al. | 148/11 |
| 3,636,579 | 1/1972 | Sakakura et al. | 148/111 |
| 4,319,936 | 3/1982 | Dadlstrom et al. | 148/111 |
| 4,595,426 | 6/1986 | Iwayama et al. | 148/111 |

*Primary Examiner*—John P. Sheehan

[57] ABSTRACT

In the production of a grain-oriented electrical steel sheet by utilizing an AlN main inhibitor and at least twice cold-rolling with a heavy final reduction, improved magnetic properties are stably obtained by controlling the cooling speed (R) in the cooling process of a hot-rolled sheet annealing (R≧5°C./sec from 600°-200° C.) and by inter-pass aging (50°-500° C. for 1 minute or more) during the first cold-rolling.

5 Claims, 6 Drawing Sheets

PROCESS FOR PRODUCING A GRAIN-ORIENTED ELECTRICAL STEEL SHEET HAVING IMPROVED MAGNETIC PROPERTIES

BACKGROUND OF THE INVENTION

1. Field of the Invention

The present invention relates to a method for producing a grain-oriented electrical steel sheet having an improved watt loss-characteristic and a high magnetic flux density, and used for the core materials of a transformer or the like.

2. Description of the Related Art

A grain-oriented electrical steel sheet is a soft magnetic material used as the core materials of mainly, a transformer or other appliances, and should have good exciting and watt loss-characteristics.

The exciting characteristic is numerically expressed by $B_8$ (the magnetic flux density at an 800 A/m intensity of the magnetic field). The watt loss characteristic is numerically expressed by $W_{17/50}$ (watt loss per 1 kg when magnetized at 50 Hz up to 1.7 T).

The grain-oriented electrical steel sheet is obtained for developing usually by utilizing the secondary recrystallization the so called Goss texture having {110}plane on the surface of a steel sheet and <001>axis in the rolling direction. To obtain good magnetic properties, it is important to precisely align the <001>axis, which is an easy direction of magnetization, in the rolling direction. The magnetic properties are greatly influenced by sheet thickness, grain size, resistivity, surface coating, purity of a steel sheet, and the like.

The orientation property has been drastically enhanced by methods which are characterized by using MnS and AlN as the inhibitors and a heavy, final cold-rolling. Together with the enhancement in the orientation property, the watt loss characteristic has been also considerably enhanced.

Meanswhile, under the background of recent increases in energy costs, the transformer producers have further intensified their tendency to use low watt loss-blank materials. Although the development of amorphous alloys, 6.5% Si steel and the like has advanced, there still remain problems in the industrial use of these alloys for transformers. On the other hand, the techniques of controlling magnetic domains by a laser and the like have been recently developed and have drastically improved the watt loss characteristic. In addition, since the effect of the technique of controlling magnetic domains becomes higher when the product sheet thickness is thinner and the magnetic flux density is higher, there is an increasing necessity to develop products having a thin sheet thickness and a high magnetic flux density.

A method is known for enhancing the magnetic flux density by using the AlN inhibitor and a heavy final cold-rolling at a rolling rate of more than 80%. This method, however, involves a problem of unstable secondary recrystallization at a thin sheet thickness.

U.S. Patent No. 3,632,456 proposes a method for solving this problem by annealing a hot-rolled strip, successivly cold-rolling and intermediate annealing, and subsequently, carrying out a heavy final cold-rolling at a draft exceeding 80%. The secondary recrystallization is stabilized at a thickness down to 0.14 mm by this method, but a completely satisfactory watt-loss characteristic is attained only with difficulty, because of, for example, a decrease in the magnetic flux density.

As described above, there are problems remaining in enlarging the range of a sheet thickness, in which products have an improved watt loss and high magnetic flux density are obtained, to include those having a thin sheet thickness.

Japanese Examined Patent Publication No. 54-13,846 discloses that, in the production of a grain-oriented electrical steel sheet having a high magnetic flux density by utilizing AlN as the inhibitor and carrying out a single heavy cold-rolling at a rolling rate of from 81 to 95%, the magnetic properties are improved by aging during the single heavy coldrolling. Further, Japanese Examined Patent Publication No. 56-3,892 discloses that, in a method for producing a grain-oriented electrical steel sheet by cold-rolling twice or more, the magnetic properties are improved by subjecting the steel to aging during the final cold-rolling and by controlling, in a relationship with this aging, the cooling speed of an intermediate annealing which is a step preceding the last final cold-rolling. It is also disclosed in Japanese Unexamined Patent Publication No. 58-25425 that, in a method for producing a grain-oriented electrical steel sheet by a double rolling method with a final cold-rolling rate of from 40 to 80%, the magnetic properties are improved by subjecting the steel to aging during the first cold-rolling and second cold-rolling. Nevertheless, these three techniques cannot provide products having an improved watt loss and high magnetic flux density, even for products having a sheet thickness of 0.20 mm or less.

SUMMARY OF THE INVENTION

It is an object of the present invention to provide a method for solving the problems as described above involved in the production of a grain-oriented electrical steel sheet by using AlN as the main inhibitor, particularly the problems wherein a high magnetic flux density, and hence an improved watt loss-characteristic, are not obtained for thin products.

In accordance with the objects of the present invention there are provided, a process for producing a grain-oriented electrical steel sheet having improved magnetic properties, wherein AlN is used as a main inhibitor, and a hot-rolled silicon steel sheet is successively subjected to annealing of a hot-rolled strip, cold-rolling is carried out at least twice including the final cold-rolling with a heavy reduction of from more than 80% to 95%, an intermediate annealing is made between the cold-rolling operations, and decarburization annealing and a final finishing annealing is carried out, characterized in that the cooling speed in a temperature range of from 600 to 200° C. in the annealing of a hot-rolled sheet is at least 5° C./sec, and a steel sheet is held in a temperature range of from 50 to 500° C. for at least 1 minute in an at least one inter-pass of a plurality passes of the first cold-rolling.

The present inventors investigated various ways in which to solve the problem involved in the production of a grain-oriented electrical steel sheet having improved magnetic properties, wherein AlN is used as a main inhibitor, and a hot-rolled silicon steel sheet is successively subjected to annealing of a hot-rolled strip, cold-rolling is carried out at least twice including the final cold-rolling with a heavy reduction of from more than 80% to 95%, an intermediate annealing is made between the cold-rolling operations, and decarburization annealing and a final finishing annealing is carried out. Namely, the problem wherein as a decrease in the sheet thickness occurs, a high magnetic flux density becomes difficult to obtain, and hence an improved watt-loss characteristic is obtained only with difficulty. The present inventors discovered that the magnetic properties are further enhanced even at a sheet thickness of 0.10 mm by setting the cooling speed in a temperature range of from 600 to 200° C. in the annealing of a hot-rolled sheet to at least 5° C./sec, and holding a steel sheet in a temperature range of from 50 to 500° C. for at least 1 minute in an at least one inter-pass of a plurality passes of the first cold-rolling.

This discovery that the combination of a controlled cooling speed and the aging treatment in the first cold-rolling creates an effect, which causes the enhancement of magnetic properties of product due to the subsequent, intermediate annealing, heavy cold-rolling of more than 80%, decarburization annealing, finishing annealing, steps and thereafter, is absolutely novel.

The present invention is described hereinafter in more detail.

The hot-rolled steel sheet which is the starting material of present invention must contain from 2.5 to 4.0% of Si, from 0.03 to 0.10% of C, from 0.010 to 0.065% of acid-soluble Al, from 0.0010 to 0.0150% of N, from 0.02 to 0.30% of Mn, from 0.005 to 0.040% of S, and 0.4% or less of at least one of Sn, Sb, Cu, and Cr.

When the Si content exceeds 4.0%, serious embrittlement occurs, so that the cold-rolling becomes disadvantageously difficult. When the Si content is less than 2.5%, the electric resistance is too low and it is difficult to attain an improved watt loss.

When the C content is less than 0.03%, the $\gamma$ amount prior to the decarburization process becomes extremely small and a good primary recrystallized structure is obtained with difficulty. On the other hand, when the C content is more than 0.10%, the decarburization failures disadvantageously occur.

The acid-soluble Al and N are basic components for obtaining the main inhibitor AlN, which is indispensable for obatining a high magnetic flux density. When the acid-soluble Al and N contents are outside the above ranges, the secondary recrystallization becomes disadvantageously unstable. Therefore, the acid-soluble Al content is set to be from 0.010 to 0.065%, and the N content is set to be from 0.0010 to 0.0150%.

Mn and S are elements necessary for forming the inhibitor MnS, and the secondary recrystallization becomes disadvantageously unstable the contents of Mn and S are outside the above ranges. Therefore, the Mn content is set to be from 0.02 to 0.30%, and the S content is set to be from 0.005 to 0.040%.

Note, 0.4% or less of one or more of Sn, Sb, Cu, and Cr must be contained as an inhibitor element. This upper limit must be strictly observed, since the secondary recrystallization is impeded at an amount exceeding the upper limit. It will be evident to persons skilled in the art that Se, As, Bi, and like known constituting elements of the inhibitor are contained therein.

The premise of present invention is that a hot-rolled sheet of silicon steel containing the above components is used as the starting material and is subjected to the successive steps of annealing of a hot-rolled sheet, cold-rolling at least twice, including the final cold-rolling with a heavy reduction, intermediate annealing between the cold-rolling operations, decarburization-annealing after the final cold-rolling, and a final finishing annealing. This process provides a relatively stable secondary recrystallization of a sheet of a sheet thickness as low as 0.14 mm, but tneds to decrease the magnetic flux density. Therefore, a low watt loss cannot be obtained.

The present inventors made it possible to secondary-recrystallize a thin product as thin as approximately 0.10 mm, and improve the magnetic flux density and watt loss, by the above-mentioned steps and by controlling the cooling during the annealing of a hot-rolled sheet and the aging during the first cold-rolling.

The production process according to the present invention is now described.

First, a hot-rolled steel sheet having the components as described above is subjected to annealing. In this annealing, a hot-rolled sheet is held at a temperature of from 700 to 1200° C. for from 30 seconds to 30 minutes.

The cooling conditions after holding in an annealing of hot-rolled sheet and the aging conditions between the passes of the first cold-rolling, as well as the reasons for limiting these conditions, are now described.

It is necessary in the cooling process during the annealing of a hot-rolled sheet that a cooling of between 600 to 200° C. be carried out at 5° C./sec or faster, and a steel sheet be held at least once for at least 1 minute in a temperature range of from 50 to 500° C. between a plurality of passes of the first cold-rolling. An assumption obtained as a result of various experiments into controlling the deformed structure by inter-pass aging during the first cold-rolling, and hence enhancing the magnetic properties of products, was that a satisfactory presence of solute C and N, fine carbides and fine nitrides in a steel sheet prior to the first cold-rolling is an extremely important factor. That is, the concept realized was that, to obtain successful inter-pass aging effects during the first cold-rolling and passing them onto the intermediate annealing, final cold-rolling with a heavy reduction, decarburization annealing, finishing annealing, and thereafter, and hence improving the magnetic properties of a product, it is necessary to obtain effective solute C and N, fine carbides and fine nitrides by rapidly cooling after holding during the annealing of a hot-rolled sheet. Based on this concept, attention was paid to the cooling speed at a temperature between 600 and 200° C., presumably lying in the C precipitation zone, and investigations were made into the conditions of the inter-pass aging during the first cold rolling, so that the effects of the inter-pass aging appear during the first cold-rolling. The results are described hereinafter with reference to the drawings.

DESCRIPTION OF THE PREFERRED EMBODIMENTS

Figure 1:
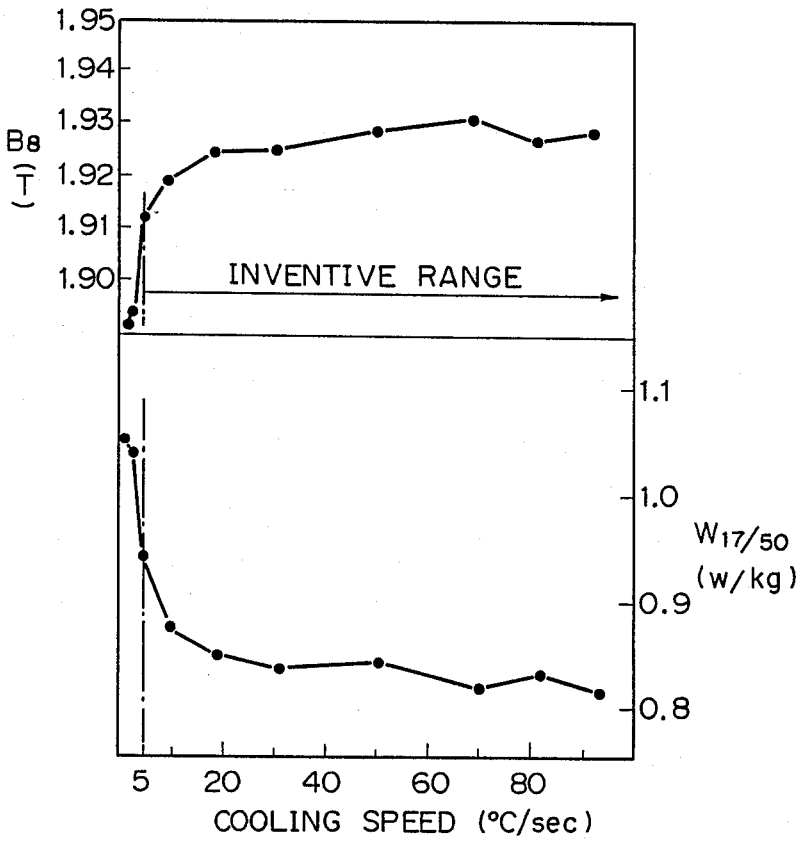
FIG. 1 illustrates a relationship between the speed of cooling after holding in a hot-rolled sheet annealing process and the magnetic properties of a product subjected to inter-pass aging during the first cold-rolling.

Referring to FIG. 1, a relationship between the magnetic properties and the speed of cooling after annealing of a hot-rolled sheet in a temperature region of between 600 and 200° C. is illustrated. In the investigation, a 2.3 mm thick hot-rolled sheet containing 3.27% of Si, 0.075% of C, 0.026% of acid-soluble Al, 0.0081% of N, 0.083% of Mn, 0.025% of S, and 0.12% of Sn was used as the starting material, and was subjected to holding at 1000° C. for 3 minutes, followed by cooling at various cooling speeds, pickling, a first cold-rolling to reduce the thickness to 1.25 mm (reduction: approximately 46%) with aging twice by holding at 250° C. for 5 minutes between passes, an intermediate annealing with holding at 1120° C. for 30 seconds, and then holding at 850° C. for 1 minute, followed by rapidly cooling, pickling, final heavy cold-rolling by a reduction of approximately 86%, to reduce thickness to 0.170 mm, decarburization-annealing by a known method, applying an annealing separator mainly composed of MgO, final finishing annealing at 1200° C., and applying a tension coating. As is apparent from FIG. 1, the cooling speed by which the magnetic properties are improved is 5° C./sec or more. The upper limit of the cooling speed is not specifically limited, but a cooling speed of 200° C./sec or less is industrially desirable because an excessive rapid cooling degrades the shape of the material. The cooling method is not necessarily specified in that the cooling speed within the above range can be attained industrially by water-cooling, gas-cooling, gas-water cooling, and the like.

After the annealing of the hot-rolled sheet, the first cold-rolling, which is a feature according to the present invention, is carried out.

In an at least one inter-pass of a plurality of cold-rolling passes, a steel sheet must be held for 1 minute or more in a temperature range of from 50 to 500° C.

Figure 2:
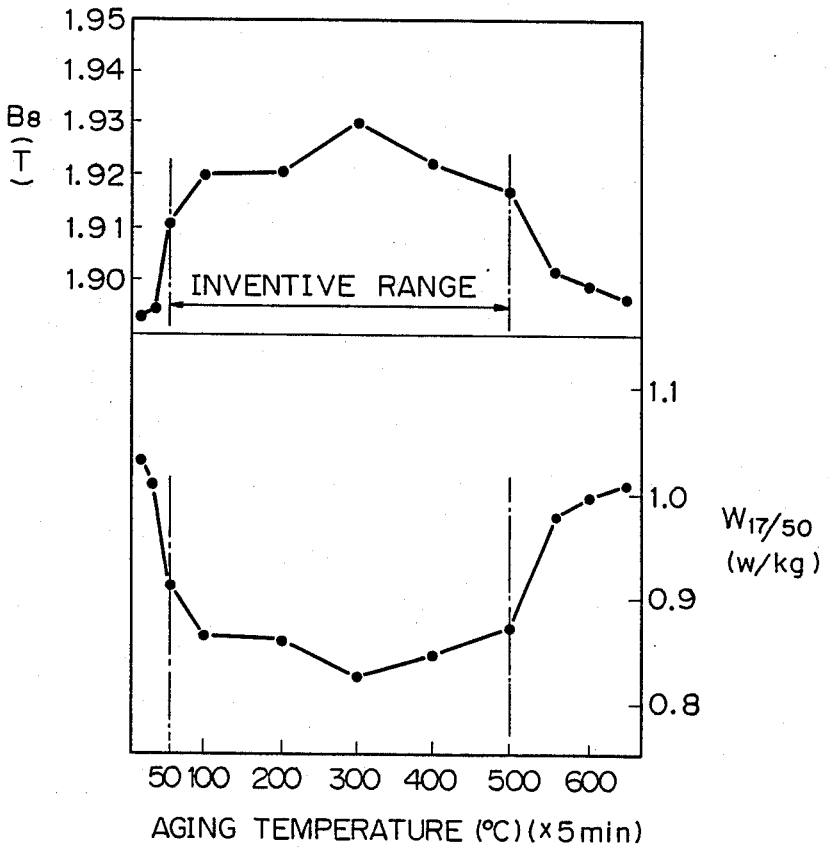
FIG. 2 illustrates a relationship between the inter-pass aging temperature in the first cold-rolling and the magnetic properties of the product.

Referring to FIG. 2, a relationship between the magnetic properties and the inter-pass aging temperature during the first cold-rolling is illustrated.

In the investigation, a 2.3 mm thick hot-rolled sheet containing 3.22% of Si, 0.076% of C, 0.026% of acid-soluble Al, 0.0086% of N, 0.073% of Mn, 0.025% of S, and 0.12% of Sn was used as the starting material, and was subjected to holding at 1000° C. for 3 minutes followed by cooling from 600 to 200° C. at a cooling speed of 20° C./sec, pickling, a first cold-rolling to reduce the thickness to 1.25 mm (reduction: approximately 46%) with aging twice by holding at various temperatures for 5 minutes between passes, a known intermediate annealing, final heavy cold-rolling by a reduction of approximately 86% to reduce the thickness to 0.170 mm, decarburization-annealing by a known method, applying an annealing separator mainly composed of MgO, final finishing annealing at 1200° C. for 20 hours, and applying a tension coating.

As is apparent from FIG. 2, the temperature range in which the magnetic properties are improved is from 50 to 500° C.

Figure 3:
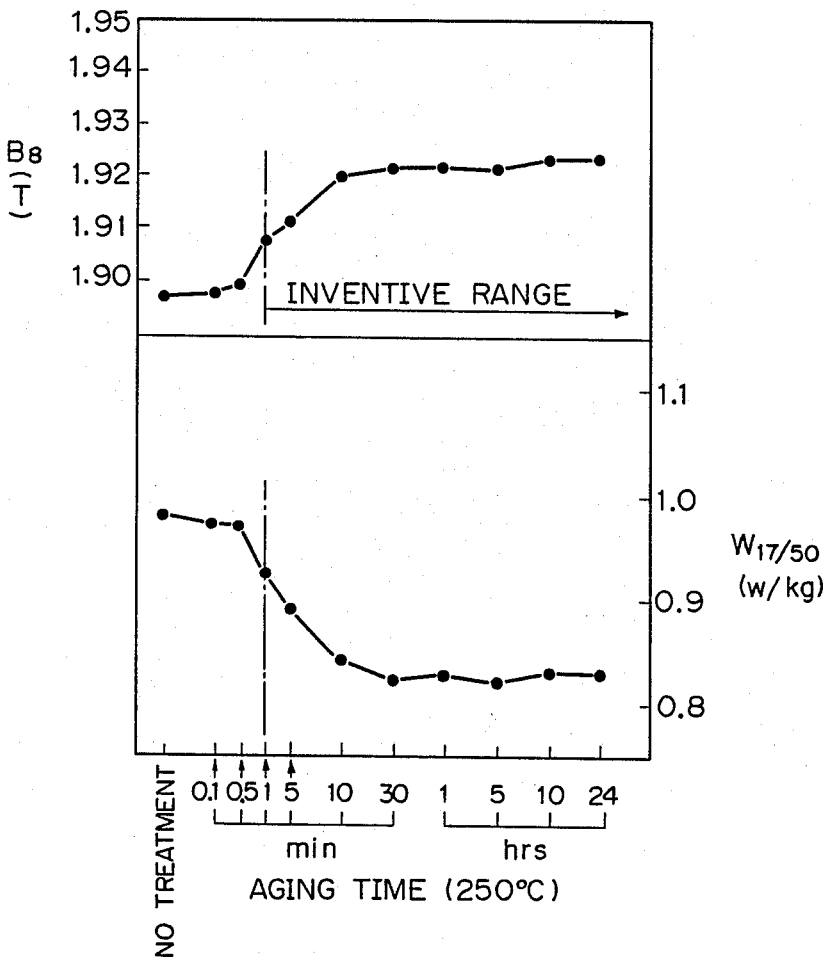
FIG. 3 illustrates a relationship between the inter-pass aging holding time during the first cold-rolling and the magnetic properties of the product.

Referring to FIG. 3, a relationship between the inter-pass aging holding time during the cold-rolling and the magnetic properties is illustrated. In this test, the sheet thickness was reduced from 2.3 mm to 1.25 mm by the first cold rolling, and steel sheets having an intermediate thickness of 1.75 mm during the cold-rolling were held at 250° C. for various times. The starting material and the conditions of the processes, except for the first cold-rolling, are the same as in the experiments illustrated with reference to FIG. 2. As is apparent from FIG. 3, the aging time by which the magnetic properties are effectively improved is 1 minute or more.

The conditions of inter-pass aging in the first rolling are stipulated based on FIGS. 2 and 3. That is, a steel sheet is held at least once between a plurality of cold rolling passes at a temperature of from 50 to 500° C. for 1 minute or more. The upper limit of the aging time is not specified but is desirably selected in the light of productivity such that the aging is completed in 5 hours or less. When the aging temperature is lower, the aging time will be longer. Although even a one-time aging is effective, the magnetic properties are further improved by alternately repeating the rolling and aging processes. The aging temperature can be obtained by utilizing the working heat during cold-rolling. If, however, the temperature rise in the cold-rolling is not sufficient, a heating or annealing plant may be utilized.

The reduction ratio of the first cold rolling is not specified but is preferably in the range of from 10 to 80% in the light of stabilizing the magnetic properties.

Figure 4:
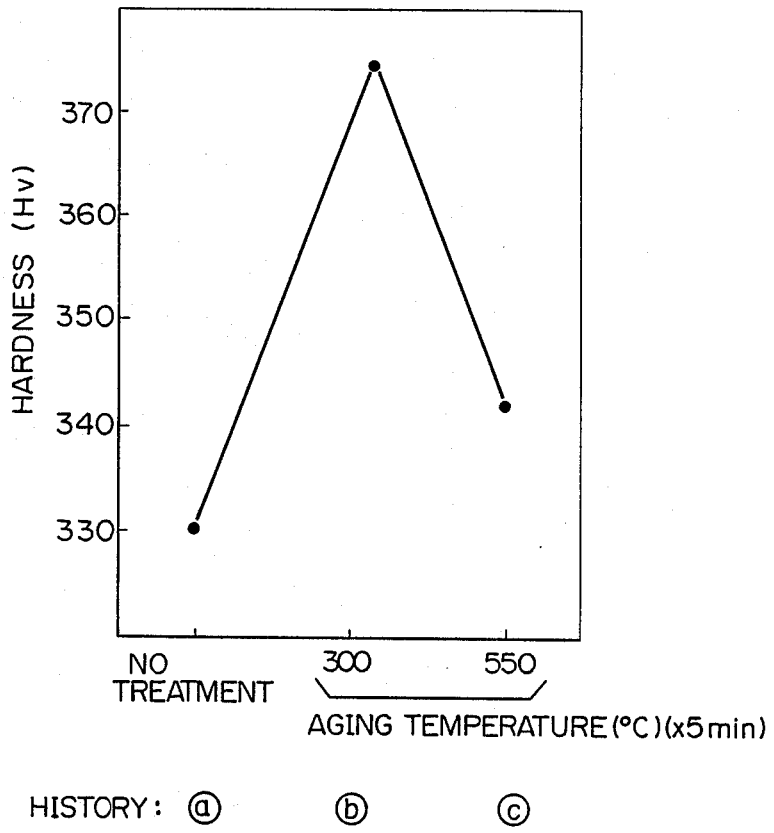
FIG. 4 illustrates a relationship between the conditions for inter-pass aging during the cold-rolling and the Vickers hardness of a cold-rolled sheet.
Figure 5:
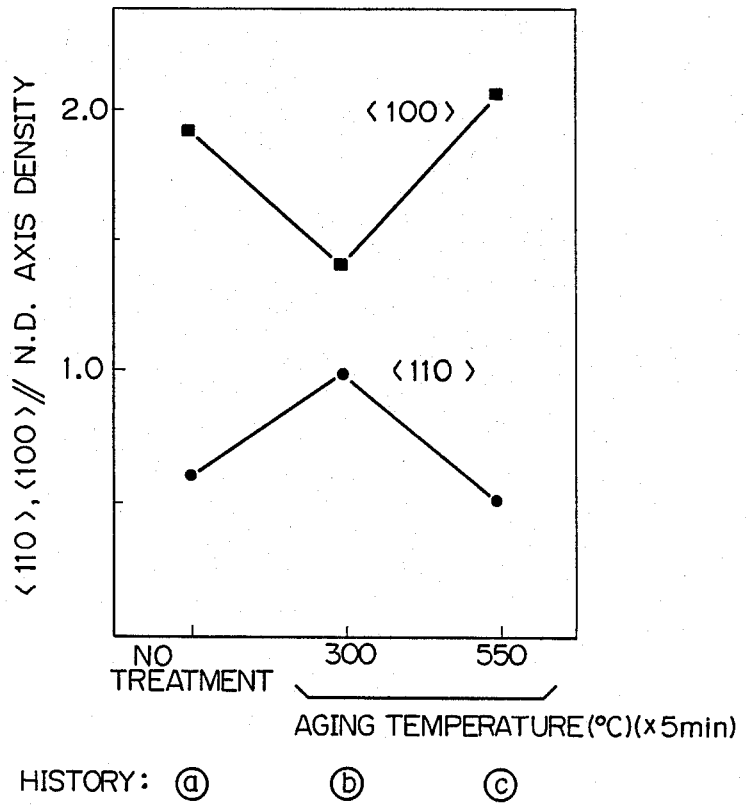
FIG. 5 illustrates a relationship between the conditions for inter-pass aging during the first cold-rolling and the texture after intermediate annealing; and, FIG. 6 shows microphotographs which illustrate a relationship between the inter-pass aging of the first cold-rolling and the metal structure after intermediate annealing.
Figure 6:
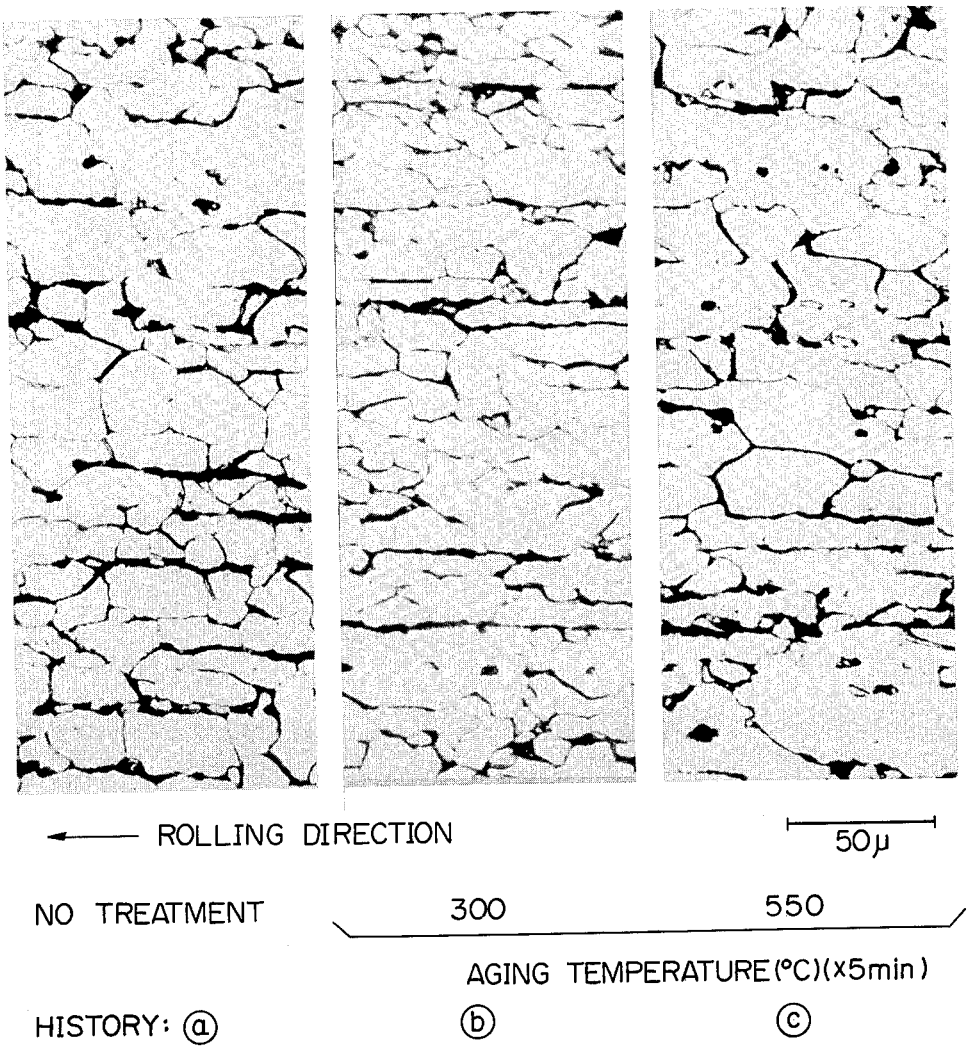

The present inventors consider the mechanism of effects realized by the inter-pass aging of the first cold-rolling to be as follows. Referring to FIG. 4, a relationship between the conditions for inter-pass aging during the first cold-rolling and Vickers hardness (1 kg of load, measured at a center of the sheet thickness and along the width of a sheet) after the first cold-rolling is illustrated. Referring to FIGS. 5 and 6, the relationships between the conditions for inter-pass aging during the fist cold-rolling, and the texture (central layer) and metal structure (central layer, cross section along the width) after the subsequent intermediate annealing, respectively, are illustrated. The starting material for these experiments was 2.3 mm thick hot-rolled sheet having the same components described with reference to FIG. 2. This hot-rolled sheet was held at 1000° C. for 3 minutes, followed by a rapid cooling from 600 to 200° C. at a speed of 20° C./sec. Subsequently, pickling and cold-rolling to reduce the thickness to 1.25 mm were carried out.

In intermediate cold-rolling stages where the sheet was reduced to 1.84 and 1.47 mm, ⓐ treatment was not carried out, ⓑ steel sheets were aged by holding at 300° C. for 5 minutes, and ⓒ steel sheets were aged by holding at 550° C. for 5 minutes. Subsequent to the cold-rolling, reheating to 1130° C. and holding for 30 seconds were carried out, followed by cooling, holding at 850° C. for 1 minute, and then rapid cooling. As is apparent from FIGS. 4 through 6, when the history is ⓑ according to the present invention, the hardness after the cold-rolling is higher, and in addition, after the subsequent annealing the {110}oriented grains increase but the {100}oriented grains decrease, and coarse grains decrease and the grains are refined. The interpass aging according to the present invention exerts an influence upon the deformtion mechanism, presumably due to the pinning action of defects such as dislocations and the like formed by the cold-rolling, for pinning the solute C and N, and the impeding action of fine carbides and fine nitrides upon the movement of dislocations. Accordingly, there seems to be an increase in the hardness after the first cold-rolling, as illustrated in FIG. 4. The variations in the deformation behaviour as described above seem to affect the recrystallization behaviour in the subsequent intermediate annealing, with the result that, as illustrated in FIGS. 5 and 6, the {110}oriented grains increase, {100}oriented grains decrease, and grain-refinement occurs in the subsequent intermediate annealing. The effect of inter-pass aging upon a change in the texture and metal structure of an intermediate annealed sheet seems to through the subsequent heavy cold-rolling of more than 80%, and then of the secondary recrystallization phenomenon during the finishing annealing, stabilize the secondary recrystallization and improve the magnetic properties.

The cooling controlling in the cooling process of a hot-rolled sheet annealing according to the present invention seems to promote the controlling effect of a deformation structure by solute C and N, fine carbide, and fine nitride, thereby improving the magnetic properties of a product.

The intermediate annealing is carried out by a known method. The magnetic properties are further improved by enhancing the temperature-elevating speed.

The reduction in the final heavy cold-rolling must be from more than 80% to 95%. A high magnetic flux density is difficult to obtain at a reduction of 80% or less, and at a reduction rate exceeding 95%, the texture after decarburization annealing becomes inappropriate and hence causes instability in the secondary recrystallization. The magnetic properties are further improved by carrying out an inter-pass aging during this cold-rolling as disclosed in Japanese Examined Patent Publication No. 54-13,846.

After the final heavy cold-rolling, the steel sheet is subjected to a decarburization annealing at a temperature of from 700 to 900° C. An annealing separator is applied on the steel sheet, which has been decarburization annealed, and the final finishing annealing is then carried out at a temperature of more than 1000° C., and a product is obtained. After the final finishng annealing, a coating for imparting tension to a steel sheet may be applied, to further improve the magnetic properties.

The present invention is now described by way of examples.

EXAMPLE 1

A 2.3 mm thick hot-rolled sheet containing 3.21% of Si, 0.076% of C, 0.026% of acid-soluble Al, 0.0086% of N, 0.073% of Mn, 0.025% of S, 0.11% of Sn, and 0.07% of Cu was annealed at 1000° C. for 3 minutes (soaking) and then pickled. Two levels of cooling in the annealing of a hot-rolled sheet were carried out: ⓐ immersing the steel sheet in hot water at 100° C. immediately after the soaking, and, ⓑ loading in a furnace at 850° C., then furnace-cooling to 550° C., and subsequently, air-cooling. After the above cooling, the first cold-rolling was carried out at a reduction of approximately 46% to reduce the thickness to 1.25 mm. The two treatments ① and ② were then carried out: ① at intermediate thicknesses of 1.84 mm and 1.47 mm in the first cold-rolling, the aging was carried out at 300° C. for 5 minutes (soaking); and ② no treatment. Subsequently, after holding at 1130° C. for 30 seconds, holding at 850° C. for 1 minute, a rapid cooling, and a cold-rolling at a reduction of approximately 86% were carried out to obtain a thickness of 0.170 mm. The obtained cold-rolled sheet was decarburization annealed by a known method. After the application of the annealing separator, the final finishing annealing was carried out at 1200° C. for 20 hours, and the tension coating was applied to obtain a grain-oriented electrical steel sheet. In Table 1, the history of materials, the cooling speed of from 600 to 200° C. in the cooling of a hot-rolled steel sheet-annealing, and the magnetic properties, are given.

TABLE 1

| History | Cooling speed between 600~200° C. (°C./sec) | $B_8$ (T) | $W_{17/50}$ (W/kg) | Remarks |
|---|---|---|---|---|
| ⓐ ① | 19 | 1.93 | 0.80 | Invention |
| ⓐ ② | " | 1.91 | 0.89 | Comparative |
| ⓑ ① | 0.1 | 1.90 | 0.93 | Comparative |
| ⓑ ② | " | 1.90 | 0.92 | Comparative |

EXAMPLE 2

A 2.3 mm thick hot-rolled sheet containing 3.50% of Si, 0.084% of C, 0.025% of acid-soluble Al, 0.0080% of N, 0.075% of Mn, 0.024% of S, 0.15% of Sn, 0.06% of Cu, and 0.05% of Cr was annealed at 980° C. for 3 minutes (soaking) and then pickled. In the cooling after soaking in the hot-rolled sheet-annealing, various cooling speeds were obtained by combining furnace cooling, air cooling, cooling in hot water at 100° C., and brine cooling. The hot-rolled sheet was pickled and then subjected to the first cold-rolling at a reduction of approximately 37% to obtain a thickness of 1.45 mm. At an intermediate sheet thickness of 1.8 mm in the first cold-rolling, the following four treatments were carried out: ① no treatments; ② 50° C.×4 hours (soaking); ③ 250° C.×20 minutes (soaking); and ④ 600° C.×10 minutes (soaking). Subsequently, an intermediate annealing at 1080° C. followed by a rapid cooling were carried out. Then, cold-rolling at a reduction of approximately 87% was carried out to obtain a thickness of 0.195 mm. The obtained cold-rolled sheet was decarburization annealed by a known method. After the application of an annealing separator mainly composed of MgO, the final finishing annealing was carried out at 1200° C. and the tension coating was applied to obtain a grain-oriented electrical steel sheet. In Table 2, the cooling speed of from 600 down to 200° C. in the cooling of a hot-rolled steel sheet-annealing, the conditions of inter-pass aging in the first cold-rolling, and the magnetic properties, are given.

TABLE 2

| No. | Cooling speed between 600~200° C. (°C./sec) | Conditions for aging between passes | $B_8$ (T) | $W_{17/50}$ (W/kg) | Remarks |
|---|---|---|---|---|---|
| 1 | 1 | ① | 1.89 | 0.95 | Comparative |
| 2 | " | ② | 1.90 | 0.93 | Comparative |
| 3 | " | ③ | 1.90 | 0.92 | Comparative |
| 4 | " | ④ | 1.90 | 0.93 | Comparative |
| 5 | 10 | ① | 1.91 | 0.90 | Comparative |
| 6 | " | ② | 1.92 | 0.86 | Invention |
| 7 | " | ③ | 1.94 | 0.84 | Invention |
| 8 | " | ④ | 1.90 | 0.93 | Comparative |
| 9 | 19 | ① | 1.91 | 0.91 | Comparative |

TABLE 2-continued

| No. | Cooling speed between 600~200° C. (°C./sec) | Conditions for aging between passes | $B_8$ (T) | $W_{17/50}$ (W/kg) | Remarks |
|---|---|---|---|---|---|
| 10 | " | ② | 1.93 | 0.85 | Invention |
| 11 | " | ③ | 1.94 | 0.82 | Invention |
| 12 | " | ④ | 1.90 | 0.93 | Comparative |
| 13 | 50 | ① | 1.91 | 0.93 | Comparative |
| 14 | " | ② | 1.93 | 0.82 | Invention |
| 15 | " | ③ | 1.93 | 0.82 | Invention |
| 16 | " | ④ | 1.91 | 0.91 | Comparative |
| 17 | 110 | ① | 1.89 | 0.95 | Comparative |
| 18 | " | ② | 1.92 | 0.83 | Invention |
| 19 | " | ③ | 1.95 | 0.81 | Invention |
| 20 | " | ④ | 1.90 | 0.92 | Comparative |

EXAMPLE 3

A 2.3 mm thick hot-rolled sheet containing 3.25% of Si, 0.072% of C, 0.028% of acid-soluble Al, 0.0082% of N, 0.073% of Mn, 0.025% of S, 0.09% of Sn, 0.06% of Cu and 0.028% of Sb was annealed at 1050° C. for 3 minutes (soaking). After soaking the hot-rolled sheet, a rapid cooling was carried out by immersion in hot water at 100° C. The cooling speed between 600 and 200° C. was 19° C./sec. Subsequently, after the pickling, the first cold-rolling was carried out to reduce the thickness to 1.15 mm. The two treatments ① and ② were then carried out: ① no treatment; and ② at intermediate thicknesses of 1.8 mm and 1.5 mm in the first cold-rolling at a reduction of approximately 50%, the aging process was carried out at 250° C. for 5 minutes (soaking). Subsequently, after holding at 1120° C. for 30 seconds, holding at 850° C. for 30 seconds, rapid cooling, and then cold-rolling at a reduction ratio of approximately 85% were carried out to obtain a thickness of 0.170 mm. The obtained cold-rolled sheet was decarburization annealed by a known method. After the application of an annealing separator mainly composed of MgO, the final finishing annealing was carried out at 1200° C. and the tension coating was applied to obtain a grain-oriented electrical steel sheet. In Table 3, a history of materials, and the magnetic properties, are given.

TABLE 3

| History | $B_8$ (T) | $W_{17/50}$ (W/kg) | Remarks |
|---|---|---|---|
| ① | 1.91 | 0.91 | Comparative |
| ② | 1.93 | 0.80 | Invention |

EXAMPLE 4

A 2.3 mm thick hot-rolled sheet containing 3.35% of Si. 0.078% of C, 0.025% of acid-soluble Al, 0.0081% of N, 0.078% of Mn, 0.024% of S, 0.15% of Sn, and 0.07% of Cu was annealed at 1050° C. for 3 minutes (soaking). After soaking the hot-rolled sheet, a rapid cooling was carried out by immersion in hot water at 100° C. The cooling speed between 600 and 200° C. was 19° C./sec. Subsequently, after the pickling, the first cold-rolling at a reduction ratio of approximately 53% was carried out to reduce the thickness to 1.07 mm. The three treatments ①, ②, and ③ were then carried out: ① no treatment; ② at intermediate thicknesses of 1.9 mm, 1.6 mm, and 1.3 mm in the first cold-rolling, the aging was carried out at 200° C. for 5 minutes (soaking); and ③ the aging was carried out at 200° C. for 1 hour (soaking), at intermediate thickness of 1.7 mm. Subsequently, after holding at 1120° C. for 30 seconds, holding at 840° C. for 30 seconds, rapid cooling, and then cold-rolling at a reduction ratio of approximately 86% were carried out to obtain a thickness of 0.150 mm. The obtained cold-rolled sheet was decarburization annealed by a known method. After the application of an annealing separator mainly composed of MgO, the final finishing annealing was carried out at 1200° C. and the tension coating was applied to obtain a grain-oriented electrical steel sheet. The history of the materials and the magnetic properties are given in Table 4.

TABLE 4

| History | $B_8$ (T) | $W_{17/50}$ (W/kg) | Remarks |
|---|---|---|---|
| ① | 1.90 | 0.88 | Comparative |
| ② | 1.92 | 0.79 | Invention |
| ③ | 1.92 | 0.80 | Invention |

As is described hereinabove, a grain-oriented electrical steel sheet, even a thin product, having improved magnetic properties is stably obtained by controlling the cooling speed during the cooling process of a hot-rolled sheet annealing and by inter-pass aging during the first cold-rolling.

We claim:

1. In a process for producing a grain-oriented electrical steel sheet having improved magnetic properties, wherein a silicon-steel hot-rolled sheet containing from 2.5 to 4.0% of Si, from 0.03 to 0.10% of C, from 0.010 to 0.065% of acid-soluble Al, from 0.0010 to 0.0150% of N, from 0.02 to 0.30% of Mn, from 0.005 to 0.040% of S and 0.4% or less of at least one element selected from the group consisting of Sn, Sb, Cu, and Cr, the balance being iron and unavoidable impurities, said hot-rolled sheet being successively subjected to annealing, then an at least twice cold-rolling operation including a first cold-rolling step comprising a plurality of passes and a final cold-rolling step to effect a heavy reduction from at least 80% to 95%, an intermediate annealing between the first and final cold-rolling steps, a decarburization annealing after the final cold-rolling step, then a final finishing annealing, the improvement comprising the steps of cooling the hot rolled silicon steel sheet at a rate of at least 5° C./sec. in a temperature range from 600° C. to 200° C. during the annealing of the hot-rolled silicon steel sheet and holding the steel sheet in at least one inter-pass of the plurality of passes of the first cold-rolling step at a temperature in a range from 50° to 500° C. for at least one minute.

2. A process according to claim 1, wherein the sheet thickness of a finally cold-rolled steel sheet is from 0.10 to 0.23 mm.

3. A process according to claim 1 or 2, wherein the cooling rate is 200° C./sec or less.

4. A process according to claim 1 or 3, wherein the aging is 5 hours or less.

5. A process according to claim 1, further comprising at least one additional cold-rolling step between the first cold-rolling step and the final cold-rolling step.

* * * * *

UNITED STATES PATENT AND TRADEMARK OFFICE

CERTIFICATE OF CORRECTION

PATENT NO. : 4,824,493

DATED : April 25, 1989

INVENTOR(S) : Y. Yoshitomi, et al.

It is certified that error appears in the above-identified patent and that said Letters Patent is hereby corrected as shown below:

Column 1, line 27, in "1 " do not bold the "1"; use regular type.

Column 3, line 42, change "obating" to --obtaining--.

Column 6, line 37, change "fist" to --first--.

Column 6, line 62, change "deform-" to --deforma---.

Column 7, line 40, change "finishng" to --finishing--.

Column 10, line 64, change "claim 1 or 3" to --claim 1 or 2--.

Signed and Sealed this

Sixteenth Day of January, 1990

*Attest:*

JEFFREY M. SAMUELS

*Attesting Officer* *Acting Commissioner of Patents and Trademarks*